United States Patent [19]

Kimura et al.

[11] 4,007,250

[45] Feb. 8, 1977

[54] METHOD FOR PRODUCING INFUSIBLE AND INSOLUBLE STYRENE COPOLYMERIC FIBERS

[75] Inventors: Isao Kimura, Suita; Koichiro Ohtomo, Takatsuk; Katsushi Shirane, Settsu, all of Japan

[73] Assignee: Kanebo, Ltd., Tokyo, Japan

[22] Filed: Oct. 22, 1975

[21] Appl. No.: 624,713

Related U.S. Application Data

[63] Continuation of Ser. No. 350,931, April 13, 1973, abandoned.

[30] Foreign Application Priority Data

Apr. 14, 1972 Japan ..... 47-37898

[52] U.S. Cl. ..... 264/236; 8/115.5; 264/210 F; 264/347

[51] Int. Cl.[2] ..... B29C 25/00

[58] Field of Search ..... 264/236, 210 F, 347; 8/115.5

[56] References Cited

UNITED STATES PATENTS

| | | | |
|---|---|---|---|
| 2,933,460 | 4/1960 | Richter et al. | 264/205 |
| 3,055,729 | 9/1962 | Richter et al. | 264/205 |
| 3,233,026 | 2/1966 | Richter et al. | 264/205 |

*Primary Examiner*—Jay H. Woo

*Attorney, Agent, or Firm*—Woodhams, Blanchard and Flynn

[57] ABSTRACT

Infusible and insoluble styrene copolymeric fibers are prepared by copolymerizing styrene with an olefinic compound having at least one functional group selected from haloalkyl group, amino group, carboxyl group, carbonic acid ester group, carbonic acid halide group, hydroxyl group, amido group, nitrile group and halogen atom, melt spinning the resulting styrene copolymer into fibers and treating the formed fibers with a cross-linking agent to form three dimensional cross-linkages in the fibers.

17 Claims, No Drawings

METHOD FOR PRODUCING INFUSIBLE AND INSOLUBLE STYRENE COPOLYMERIC FIBERS

This is a continuation, of application Ser. No. 350,931, filed Apr. 13, 1973 and now abandoned.

The present invention relates to infusible and insoluble styrene copolymeric fibers and a method for producing said fibers.

In general, styrene polymers obtained from styrene monomer have been recently broadly used because of their excellent polymerizability and moldability. However, styrene polymers are low in heat resistance and their field of use is limited. Recently, development of heat resistant polymeric materials has been demanded due to developments in airplane. Therefore, novel fibers composed of heat resistant high polymers, such as PBI fiber (made by Celanese Co.) obtained by ring forming polycondensation reaction in hetero-cyclic synthesis, Nomex fiber (made by Du Pont Co.) obtained from an aromatic polyamide and the like, have been developed. However, these fibers are not sufficient in the infusible property and are remarkably expensive and further these fibers cannot be produced commercially advantageously.

Accordingly, the inventors have studied diligently the production of infusible and insoluble fibers having a high heat resistance and the present invention has been accomplished.

An object of the present invention is to provide infusible and insoluble styrene copolymeric fibers having a high heat resistance.

Another object of the present invention is to provide a method for producing the styrene copolymeric fibers having the above described properties commercially advantageously.

The infusible and insoluble styrene copolymeric fibers according to the present invention consist in three dimensionally cross-linked products made of copolymers of styrene and an olefinic compound having at least one functional group selected from haloalkyl group, amino group, carboxyl group, carbonic acid ester group, carbonic acid halide group, hydroxyl group, amido group, nitrile group and halogen atom.

The infusible and insoluble styrene copolymeric fibers according to the present invention are produced by copolymerizing styrene with an olefinic compound having at least one functional group selected from haloalkyl group, amino group, carboxyl group, carbonic acid ester group, carbonic acid halide group, hydroxyl group, amido group, nitrile group and halogen atom and spinning the resulting copolymer into fibers and then treating the fibers with a cross-linking agent to form three-dimensional cross-linkages.

The olefinic compounds having the above described functional groups are shown by the general formulae $HCR_1{=}CR_2(CH_2)_nX$ or

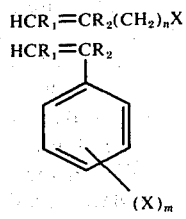

wherein $R_1$ is hydrogen, a lower alkyl group having 1 to 4 carbon atoms, halogen atom, carboxyl group or the ester groups thereof, $R_2$ is hydrogen, a lower alkyl group having 1 to 4 carbon atoms or phenyl group, X is haloalkyl group, amino group, carboxyl group, carbonic acid ester group, carbonic acid halide group, hydroxyl group, amido group (including sulfonamido group, n-methylolamido group), nitrile group or halogen atom, $n$ is 0 or 1 and $m$ is 1, 2 or 3. For example, these compounds are arcylic amide, n-methylolacrylic amide, acrylic acid, methyl acrylate, methyl methacrylate, ethyl methacrylate, vinyl chloride, acrylonitrile, allyl alcohol, allyl chloride, chloromethylstyrene, aminostyrene, aminomethylstyrene, hydroxystyrene, p-vinylbenzamide, p-styrenesulfonic amide, bromostyrene, vinylbenzoic acid, vinylbenzylalcohol, N,N-dimethylaminostyrene, vinylpyridine, fumaric acid, dichloromethylstyrene, diaminomethylstyrene, and the like. Furthermore, maleic anhydride, vinylidene chloride and the like may be used.

The above described olefinic compounds can be easily copolymerized with sytrene monomer in a conventional manner to form styrene copolymers. The copolymerization ratio can be conveniently selected considering the kind of the olefinic compound and the amount of functional group in the copolymer to be produced but usually the molar ratio of styrene to the olefinic compound is 99/1 – 20/80, preferably, 95/5 – 40/60.

When the amount of the olefinic compound is too small, the fibers composed of the resulting styrene copolymer are not fully cross-linked three dimensionally and therefore it is impossible to provide a satisfactory infusible and insoluble property to said fibers. On the other hand, when the amount of styrene is too small, the resulting copolymer provides an excess amount of cross-linkage as a result of the subsequent three dimensional cross-linking treatment, so that the resulting fibers have satisfactory infusible and insoluble properties but they are brittle and their elongation decreases. Consequently, such amounts are not preferable.

The copolymerization of the above described styrene with the olefinic compound may be effected in a radical polymerization process, such as bulk polymerization, solution polymerization, emulsion polymerization, suspension polymerization or in redox polymerization, ion polymerization and the like. Of course, copolymerization of at least three monomers may be effected.

The thus obtained sytrene copolymers, if necessary, after the remaining monomer is distilled off, are subjected to melt spinning within a temperature range of 100° C to 250° C. In this case, the molecular weight of the copolymer has a considerable influence on the spinnability and the yarn properties of the spun fibers and in general, the molecular weight is preferred to be more than 2,000.

The above described sytrene copolymers are poor in heat resistance and further contain the functional groups and therefore the spinning temperature is naturally limited for protecting the functional groups. The upper limit of the spinning temperature is generally about 300° C, preferably, not higher than 250° C. When the spinning temperature is excessively high, the styrene copolymers cause thermal decomposition and further the functional groups having a high reactivity cause unnecessary decomposition reaction in the copolymer and consequently it is impossible to obtain filaments of the styrene copolymers having a uniform structure by means of melt spinning. Accordingly, a uniform three dimensional cross-linking treatment cannot be effected with a cross-linking agent and the object of the present invention cannot be accomplished. Thus, in order to make is possible to effect melt spinning at that maximum temperature, the molecular weight of the styrene copolymers is naturally limited.

The molecular weight of the styrene copolymers is preferred to be 4,000 – 500,000, more particularly, 20,000 – 100,000.

When the molecular weight of the styrene copolymers is less than 2,000, the spinnability and drawability thereof are too low to obtain fibers having satisfactory strength and elongation by melt spinning, whereas when the molecular weight of the copolymer is unnecessarily high, the melt spinning becomes difficult. Thus, the sytrene copolymers are limited in their molecular weight range in order to protect the thermal property and functional group in correlation to the melt spinning temperature.

In addition, when it is difficult to increase the viscosity of the copolymer of the copolymerizability is poor, a previously prepared polystyrene having a high polymerization degree may be blended with the above described stryene copolymer or a homopolymer of the above described olefinic compound having functional groups. By such means the spinnability and the yarn properties can be improved. When the fibers formed from these blends are subjected to three dimensional cross-linking treatment, fibers having excellent infusible and insoluble properties may be obtained.

In this case, the molar ratio of styrene to the olefinic compound in the resulting blends also should be 99/1 to 20/80, preferably, 95/5 – 40/60 as in the case of the styrene copolymer alone.

Moreover, when at least two kinds of the above described styrene copolymers having different ratios of the functional groups are prepared and these copolymers are conjugate spun in a side by side relation or in a sheath-core relation or are spun in a multiple layer relation in a conventional manner and then the resulting composite fibers or layer-multiplied fibers are subjected to a three dimensional cross-linking treatment, infusible and insoluble fibers may be formed and when said fibers have an eccentric structure, an excellent crimpability can be developed.

When, in the above described spinning of sheathcore type composite filaments, the core portion is composed of the styrene copolymer having larger functional groups than the sheath portion, the three dimensional cross-linking treatment can be effected in a much shorter time.

In addition, when the sheath portion is composed of the sytrene copolymer containing the functional group and the core portion is composed of polystyrene containing no functional group and the resulting composite filaments are subjected to a three dimensional cross-linking treatment, it is possible to obtain infusible and insoluble fibers having improved yarn properties.

The process for blending the polystyrene with the homopolymer of the olefinic compound having the functional group or the styrene copolymer as mentioned above is not particularly limited, but it is most preferable in view of uniformity of mixing that both the polymers are mechanically mixed in powdery or granular form and then the resulting mixture is supplied to a mono-axial or multi-axial extruder to effect melt mixing. Alternatively, to the melted polystyrene may be added the styrene copolymer having the functional group and the resulting mixture is stirred. Furthermore, it is possible to mechanically mix both the polymers in solid state and supply the mixture to a usual melt extruder to effect mix spinning directly.

The thus obtained styrene copolymers are charged to a melt extruder or a melter type spinning machine to be spun under a non-oxidizing atmosphere to form filaments. In this case, the melt residence time of the polymers is generally preferred to be shorter, so that the use of an extruder is preferable.

Furthermore, when the filaments composed of the styrene copolymer is treated with the cross-linking agent, said filament is cross-linked from the periphery toward the inner portion gradually across the cross-section of the filament. Accordingly, if the cross-linking of the filament is stopped before the filament is completely cross-linked across the cross-section, there is formed a filament in which the sheath portion has been already cross-linked but the core portion has not yet cross-linked, that is, the core portion is soluble in a solvent. can be formed. Thus, when such a filament is immersed in a solvent, the core portion is dissolved off by the solvent but the sheath portion is not dissolved and consequently, a hollow cross-linked filament can be formed.

The resulting fibers composed of the sytrene copolymer are cold drawn or hot drawn, if necessary. This step highly influences the yarn properties, particularly, the strength and elongation of the finally obtained infusible and insoluble fibers and therefore this step is not unimportant. However, in general, the object can be attained by taking 500 – 1,000 m/min of the draft ratio in the spinning.

The spun fibers composed of the styrene copolymer are treated with a cross-linking agent to effect the three dimensional cross-linking treatment in filament form or in stable form or after forming the filament into various fibrous structures, for example, filament yarn, spun yarn, knitted or woven fabric, non-woven fabric, and the like, whereby the infusible and insoluble products can be produced.

The above described cross-linking agents may be ones having such function that the styrene copolymer can be cross-linked three dimensionally to provide infusible and insoluble properties to the fibers. However, the selection of the cross-linking agent should be interrelated to the kind of functional groups present in the styrene copolymer, so that the kind of the cross-linking agent to be used is restricted to a certain extent.

The interrelation between the kind of the preferable cross-linking agent to be used and the functional group in the styrene copolymer will be explained below.

Firstly, when the functional group in the copolymer is a haloalkyl group such as chloromethyl group, the preferable cross-linking agents are, for example, amino compounds, diols, carboxylic acids, phosphorus compounds and sulfur compounds. When the functional group is an amino group, the preferable cross-linking agents are, for example, aldehydes such as formaldehyde, diisocyanate compounds, compounds having haloalkyl group such as ethylene dichloride and ethylene dibromide (provided that this compound has at least 2 said groups), dicarboxylic acids and dicarboxylic acid dichlorides. When the functional group is a carboxyl group, the preferable cross-linking agents are, for example, bisglycidyl ether compounds such as ethylene glycol bisglycidyl ether, bisphenol A bisglycidyl ether and the like, compounds having at least 2 haloalkyl groups as described above and amino compounds.

Furthermore, when the functional group in the copolymer is a carbonic acid ester group, the preferable cross-linking agents are, for example, bisglycidyl ether compounds, compounds having at least 2 haloalkyl groups and amino compounds. When the functional group is a carbonic acid halide group, the preferable cross-linking agents are, for example, amino compounds, diol compounds and the like.

Moreover, when the functional group in the copolymer is a hydroxyl group, the preferable cross-linking agents are, for example, diisocyanate compounds and dicarboxylic acid dichlorides. When the functional group is an amido group, the preferable cross-linking agents are aldehydes such as formaldehyde and the like.

Further, when the functional group is the copolymer is a nitrile group, the preferable cross-linking agents are, for example, compounds aminoximed by hydroxylamine. When the functional group is a halogen atom, the preferable cross-linking agents are amino compounds and sulfur containing compounds.

As the above described amino compounds, mention may be made of aliphatic primary diamines such as methylenediamine, ethylenediamine, propylenediamine, tetramethylenediamine, pentamethylenediamine, hexamethylenediamine, heptamethylenediamine, octamethylenediamine, nonamethylenediamine, decamethylenediamine, undecamethylenediamine, dodecamethylenediamine and the like; diamines derived from said primary diamines and having secondary or tertiary amino group such as N,N'-dimethylethylenediamine, N,N'-dimethyltetramethylenediamine, N,N'-diethylethylenediamine, N,N'-dipropylethylenediamine, N,N'-dibutylhexamethylenediamine, N,N'-dicyclohexylethylenediamine, N,N'-dimethylethylenediamine, N,N'-dimethyl-N'-methylethylenediamine, N,N'-tetramethylenediamine, N,N'-tetraethylethylenediamine and the like; polyamines such as diethylenetriamine, dipropylenetriamine, triethylenetetramine, N,N'-di-(γ-aminopropyl)ethylenediamine, tetraethylenepentamine and the like; and N-alkyl substituted polyamines such as N,N-di(β-aminoethyl)methylamine, N,N-di-(γ-aminopropyl)ethylamine, N,N'-dimethyl-N,N'-di(β-aminopropyl)ethylenediamine, N,N'-diethyl-N-N'-di(β-aminoethyl)-ethylenediamine and N,N'-dimethyl-N,N'-di(γ-aminopropyl)-ethylenediamine.

Furthermore, the preferable amino compounds include piperazines and N-alkyl derivatives thereof, for example, piperazine, methylpiperazine, dimethylpiperazine, N,N'-di(aminomethyl)piperazine, N,N'-di(aminomethyl)-methylpiperazine, N,N'-di(aminomethyl)-2,3-dimethylpiperazine, N,N'-di(β-aminoethyl)-piperazine, N,N'-di(γ-aminopropyl)piperazine, N.N'-di(γ-aminopropyl)-2,5-dimethylpiperazine, N-(γ-aminopropyl)-N'-(aminomethyl)piperazine and the like. As the amino compound, use may be made of aromatic diamines and hydrogenated derivatives thereof, for example, phenylenediamine, xylylenediamine, 4,4'-diaminodiphenylmethane, 2,2-bis-(p-aminophenyl)propane, N,N'-di(γ-aminopropyl)-p-phenylenediamine, N,N'-di(γ-aminopropyl)-p-xylenediamine, etc. Furthermore, diamines obtained by aminoalkylation if diols, for example, bis-1,2(β-aminoethoxy)ethane, bis-1,2(γ-aminopropoxy)ethane, bis-1,3(γ-aminopropoxy)propane, bis-1,4(γ-aminopropoxy)butane, etc. may also be used.

As the said diols, use may be made of aliphatic glycols such as ethylene glycol, trimethylene glycol, tetramethylene glycol, 1,6-dihydroxyhexane, etc.; polyglycols such as diethylene glycol, triethylene glycol, tetraethylene glycol, etc.; alicyclic diols such as cyclohexane diol and cyclohexane dimethanol; and aromatic diols such as bisphenol, bisphenol-A, dihyroxybenzene, dihydroxymethylbenzene, dihydroxymethylphenol, etc.

As carboxylic acids, use may be made of dicarboxylic acids such as oxalic acid, succinic acid, glutaric acid, adipic acid, pimelic acid, suberic acid, azelaic acid, sebacic acid, dodecane dicarboxylic acid, isophthalic acid, terephthalic acid, hexahydroterephthalic acid, diphenylene-4,4'-dicarboxylic acid, diphenylmethane-4,4'-dicarboxylic acid, diphenyl ether-4,4'-dicarboxylic acid, diphenylpropane-4,4'-dicarboxylic acid, etc.; methyl or ethyl esters of these dicarboxylic acids; polybasic carboxylic acids such as trimellitic acid, pyromellitic acid, etc.; hydroxy acids such as β-hydroxyethyl carboxylic acid, γ-hydroxypropyl carboxylic acid, ε-hydroxycaproic acid, etc.; aminoacids such as glycine, glutamic acid, aspartic acid, aminocaproic acid, aminoenanthic acid, aminocaprylic acid, aminopelargonic acid, etc.; and methyl or ethyl esters of these aminoacids.

As the phosphorus compounds, mention may be made of phosphoric acid, hydroxymethylphosphoric acid, tetrakis-(hydroxymethyl)phosphonium chloride, tris(aziridinyl)phosphine oxide and the like.

As the sulfur compounds, mention may be made of sodium sulfide and dithioglycols such as methylene dithioglycol, ethylene dithioglycol, trimethylene dithioglycol, tetramethylene dithioglycol, etc.

As the diisocyanate compounds, mention may be made of tolylene diisocyanate, diphenylmethane diisocyanate, xylylene diisocyanate, hexamethylene diisocyanate and the like.

It is merely necessary that the cross-linking agents according to the present invention can easily react with the functional groups in the resulting styrene copolymers to three dimensionally cross-link the styrene copolymers and the fibers composed of the styrene copolymers are made into the infusible and insoluble fibers.

However, in order to form the three dimensional structure in the styrene copolymers having a fairly high regularity (molecular orientation) and formed into fibers, it is necessary to adjust carefully the reactivity of the styrene copolymer with the cross-linking agent, that is, the reaction rate and therefore it is essential to take into consideration the kind of cross-linking agent and the structure thereof, particularly, the molecular length and the cross-linking treatment condition, for example, concentration of cross-linking agent and the treating temperature.

For example, 40 mol%, based on styrene, of chloromethylstyrene (a mixture of ortho- and para-isomers) was added to styrene and the resulting mixture was subjected to a bulk polymerization in the presence of a catalyst of benzoyl peroxide. The resulting styrene copolymer was melt extruded at a temperature of 108° C to obtain fibers of 5 deniers. The fibers were immersed in methanol solution containing 30% by weight of amino-compound as shown in the following Table 1 at 20° C and the temperature was raised to 50° C in 1 hour and at the same temperature, the treatment was effected for one hour and then the temperature was raised to 60° C in 30 minutes. Further at the same temperature, the treatment was effected for 10 hours and then the fibers were taken out and washed with water and dried. The obtained results were shown in the following Table 1.

Table 1

| Amino compound | Acetone insoluble part (Wt.%) | Yarn property Strength (g/d) | Yarn property Elongation (%) | Heat treatment, 200° C, 2 hrs. |
|---|---|---|---|---|
| None | 0 | less than 0.5 | 3 | fusible |
| Diethylamine | 35 | 0.7 | 11 | somewhat fusible |
| Ethylenediamine | 98 | 2.6 | 74 | infusible |
| Hexamethylenediamine | 87 | 2.1 | 63 | " |
| Nonamethylenediamine | 75 | 1.8 | 49 | " |

As seen from the above Table 1, the kind of amino compound employed influences considerably the cross-linkage degree and the yarn properties. This is, phenomenon observed only in the method of the present invention wherein the amino compound is successfully introduced into the styrene copolymer formed into fiber and having a fairly high orientation degree.

In this manner, the selection of the cross-linking agent is essential and further the selection of the three dimensional cross-linking time and the concentration of the cross-linking agent in the treating bath is also important.

The three dimensional cross-linking treatment may be effected by treating the above described styrene copolymeric fibers with a solution containing the cross-linking agent as mentioned hereinafter but the concentration of the cross-linking agent in the treating bath depends upon the kind of the cross-linking agent employed and cannot be determined generally, but usually, said concentration is 0.5 – 60% by weight, preferably, 1 – 15% by weight, more particularly, 5 – 40% by weight.

When the concentration of the cross-linking agent is less than the above described range, the fibers composed of the styrene copolymer cannot be fully cross-linked three dimensionally according to the method of the present invention to provide the infusible and insoluble property. While, when the concentration exceeds the above described range, the above described fibers can be converted into the infusible and insoluble fibers, but the resulting fibers are considerably brittle and the decrease of strength and elongation is noticeable.

The three dimensional cross-linking treatment of the styrene copolymeric fibers according to the present invention can be carried out by depositing a solution containing the cross-linking agent on said fiber.

Accordingly, such depositing treatment may be effected by the following means. Firstly, the styrene copolymeric fibers are immersed in a cross-linking agent bath. Secondly, the styrene copolymeric fibers are suspended and a cross-linking agent solution is flowed down or sprayed thereon. However, if the cross-linking agent can be deposited on the fibers and the three dimensional cross-linkage can be formed on the styrene copolymer, the treating process is not particularly limited. If necessary, the three dimensional cross-linking treatment may be repeated a plurality of times.

As solvents for the cross-linking agents, use may be made of water; alcohols, such as methanol, ethanol, propanol, isopropanol and the like; ethers, such as petroleum ether, tetrahydrofuran, dioxane and the like; glycols, such as ethylene glycol, diethylene glycol and the like.

Furthermore, as swelling agents is the cross-linking treatment, if necessary, ketones, such as acetone, methyl ethyl ketone and aromatic solvents, such as benzene, toluene, xylene and the like may be added to the cross-linking bath in an amount of 5 – 30% by weight. Furthermore, in order to control pH, acids, alkalis, and the like may be added preferably.

Then, an explanation will be made with respect to the temperature and time for the three dimensional cross-linking treatment.

In general, the three dimensional cross-linking treatment begins at a temperature of 20° – 30° C and then the temperature is raised to 50° – 120° C in 0.5 – 10 hours. At said temperature, the treatment is effected for 1 – 20 hours to convert the heat fusible styrene copolymeric fibers into the infusible and insoluble fibers. In the method of the invention, it is most essential that the temperature for starting the three dimensional cross-linking treatment is kept at a temperature lower than 50° C.

Of course, said temperature somewhat varies depending upon the composition of the treating bath and the kind of functional groups in the fiber, but if the starting temperature in the three dimensional cross-linking treatment is higher than 50° C, the shrinkage of the fibers occurs and such a starting temperature is not preferable. In the method of the present invention, the three dimensional cross-linking reaction occurs gradually from the peripheral layer of the fiber and the reaction transfers into the inner portion of the fiber gradually as mentioned above. Furthermore, when the fineness of the fibers is very small, the three dimensional cross-linking reaction completes in a short time to form the fibers having a uniform cross linkage density, while when the fineness of the fibers is large, for example, more than 10 deniers, the three dimensional cross-linking treatment needs a long time, for example, several hours.

As one means for decreasing this treating time, various means may be carried out. For example, the fibers containing the functional groups are treated with a bath containing a swelling agent other than the cross-linking agent at a low temperature, whereby the cross-linking agent is previously penetrated into the inner portion of the fiber and then the thus treated fibers are heat treated to advance the cross-linking reaction rapidly resulting into decrease of the three dimensional cross-linking time.

As mentioned above, the kind of the cross-linking agent, the concentration of the cross-linking agent and the treating conditions, such as the treating temperature and time, must be fully taken into consideration.

As mentioned above, the styrene copolymers having various functional groups are poor in heat resistance and are brittle and these copolymers are easily thermally decomposed at a high temperature and various undersirable side reactions are caused due to the functional groups in the copolymers, while according to the present invention the styrene copolymers having a certain degree of molecular weight are shaped into fibers and then the resulting fibers are subjected to a three dimensional cross-linking treatment by means of a cross-linking agent, whereby the fibers can be easily converted into the infusible and insoluble fibers. As compared with the very brittle untreated fibers not subjected to the three dimensional cross-linking treatment, the infusible and insoluble fibers according to the present invention have much higher acid resistance and are considerably flexible and have much higher strength and elongation. Furthermore, the infusible and insoluble fibers according to the present invention are excellent in the whiteness and have a silk-like gloss.

When an amino compound is used as a cross-linking agent in the three dimensional cross-linking treatment, the dyeability against an acidic dyestuff is very good.

Thus, the fibers according to the present invention are insoluble in a solvent and when these fibers are heated, for example, by a burner at a high temperature, the fibers are only carbonized and are not fused. Accordingly, the infusible and insoluble fibers of the present invention can be used for electric insulating materials, reinforcing material for plastics by utilizing the excellent heat resistance as well as for general purpose cloths.

The following examples are given for the purpose of illustration of this invention and are not intended as limitations thereof.

In the examples, the "viscosity" means relative viscosity measured at 30° C in a 0.5% solution of a copolymer in chloroform, benzene or toluene, and the "part" means part by weight.

EXAMPLE 1

A mixture of 70 parts of styrene and 30 parts of chloromethylstyrene (a mixture of ortho- and para-isomers) was added with 2.5 parts of benzoyl peroxide, and subjected to a copolymerization reaction at 80° C for 12 hours. The resulting copolymer was melted at 150° C under a nitrogen atmosphere, and the pressure was reduced to 5 mmHg to distill off unreacted monomer. The thus obtained copolymer had a viscosity $\eta_{rel}$ of 0.32 in benzene.

The copolymer was made into chips, and the chips were extruded through an extruder of 20 mm$\phi$. The extruded filaments were taken up on a bobbin at a rate of 800 m/min to obtain an undrawn filament of 75 d/25 f. The undrawn filament was taken out from the bobbin and immersed in a 30% solution of pyridine in methanol in a bath ratio of 1:200 at a temperature of 20° C, then heated up to 60° C in 2 hours and further kept at 60° C for 5 hours to effect a cross-linking treatment. The filament was taken out from the bath, washed with methanol and water repeatedly, and dried at 60° C under a reduced pressure to obtain an insoluble and infusible filament.

The resulting filament having a silk-like gloss was subjected to an extraction with acetone to measure an amount of uncross-linked portion.

When the filament of the present invention was heat treated in a hot air circulating type driver kept at 200° C for 3 hours, the filament did not substantially color.

Yarn properties of the resulting filaments are shown in the following Table 2. In Table 2 and the following description of the specification, the "untreated filament" means the filament before the cross-linking treatment, and the "heat treated filament" means the above heat treated filament.

Table 2

| | Acetone insoluble part (Wt.%) | Yarn property | | |
|---|---|---|---|---|
| | | Strength (g/d) | Elongation (%) | Number of* bendings |
| Untreated filament | 0 | 0.35 | 6.5 | 600 |
| Filament of the present invention | 99 | 3.25 | 72.0 | 7,500 |
| Heat treated filament | — | 3.42 | 51.5 | 6,300 |

*Number of bendings until monofilament is broken under a load of 0.5 g/d.

As seen from Table 2, when the untreated filament is subjected to a cross-linking treatment, the filament is substantially completely converted into a three-dimensional structure, and the strength and elongation of the filament are increased to about 10 times of those of the untreated filament. Moreover, even when the filament of the present invention is heat treated at 200° C for 3 hours, the elongation is somewhat decreased, but the strength and bending strength are maintained sufficiently high, and accordingly the filament is excellent in the heat resistance. Further, when the filament of the present invention was heated to redness on a spatula by a burner, the filament was merely carbonized.

When the filament of the present invention was dyed with 2% by weight of an acid dye (Rocceline made by Sumitomo Kagaku Co.) based on the weight of the filament in a bath ratio of 1:100 at a temperature of 95° C for 150 minutes under acetic acid acidity, the dye receptivity was 52%.

EXAMPLE 2

A mixture of 85 parts of styrene, 15 parts of acrylamide and 1,000 parts of dimethylformamide was added with 1 part of $\alpha,\alpha'$-azoisobutyronitrile, and subjected to a copolymerization reaction at 90° C for 12 hours, and the reaction product was poured into 1,000 parts of methanol under vigorous stirring to precipitate a copolymer, which was filtered and dried at 60° C under a reduced pressure to obtain a powdery copolymer. The copolymer contained 0.86% by weight of nitrogen and had a viscosity $\eta_{rel}$ of 0.52.

The resulting copolymer was subjected to a test tube spinning to obtain a filament of 7 d/1 f. The spinning rate was 600 m/min.

The filament was immersed in a bath of an aqueous solution containing 30% of formaldehyde and 2% of oxalic acid in a bath ratio of 1:200, then heated from 20° C up to 75° C in 2 hours and further kept at 75° C for 10 hours to effect a cross-linking treatment. The above treated filament was washed with water thoroughly and dried to obtain an insoluble and infusible white filament.

Yarn property of the resulting filament is shown in the following Table 3 together with that of untreated filament.

Table 3

| | Dimethylformamide insoluble part (Wt.%) | Yarn property | | |
|---|---|---|---|---|
| | | Strength (g/d) | Elongation (%) | Young's modulus (g/d) |
| Untreated filament | 0 | 0.57 | 6.2 | 29.3 |
| Filament of the present | 97 | 2.41 | 57.5 | 38.1 |

Table 3-continued

| | Dimethyl-formamide insoluble part (Wt.%) | Yarn property | | |
|---|---|---|---|---|
| | | Strength (g/d) | Elonga-tion (%) | Young's modulus (g/d) |
| invention | | | | |

As seen from Table 3, in the filament of the present invention, a three dimensional structure is formed substantially completely. Moreover, the strength and elongation are considerably increased. Further, when the filament was heat treated in a hot air circulating type drier kept at 250° C for 2 hours to test the heat resistance, the filament colored yellow slightly. However, the heat treated filament had a strength of 2.47 g/d and was still excellent in the strength.

hours to effect a cross-linking treatment. The thus treated filament was an insoluble and infusible white filament.

EXAMPLE 4

A mixture of styrene and chloromethylstyrene in a molar ratio of 65/35 was subjected to a copolymerization reaction in the same manner as described in Example 1. The resulting copolymer was spun at 170° C under a nitrogen atmosphere to obtain an undrawn filament of 175 d/25 f. The undrawn filament was hot drawn at a draw ratio of 2.2 on hot draw pin kept at 70° C to obtain a drawn filament of 80 d/25 f.

The resulting drawn filament was subjected to a cross-linking treatment under a condition as shown in the following Table 4 to obtain an insoluble and infusible filament.

The obtained results are shown in Table 4.

Table 4

| | Treating condition | | | Treating time (hr.) | | Benzene insoluble part (Wt.%) | Yarn Property | | Heat treatment, 250° C, 2 hrs. |
|---|---|---|---|---|---|---|---|---|---|
| | Cross-linking agent | Solvent | Concen-tration (%) | from 20° C up to 60° C | 60° C | | Strength (g/d) | Elonga-tion (%) | |
| Untreated filament | — | — | — | — | — | 0 | 0.82 | 2.1 | fusible |
| Filament of the present invention | diethylene-triamine | ethanol | 20 | 3 | 8 | 96 | 2.5 | 29.4 | infusible |
| " | disodium salt of ethylene glycol | tetra-hydro-furan | 5 | 2 | 6 | 97 | 3.2 | 22.5 | " |
| " | tetrakis(hydroxy-methyl)phospho-nium chloride | iso-propyl alcohol | 40 | 2 | 10 | 92 | 2.0 | 15.1 | " |
| " | sodium oxalate | water | 10 | 3 | 10 | 72 | 1.4 | 7.5 | " |
| " | sodium sulfide | water | 15 | 2 | 10 | 91 | 2.4 | 15.2 | " |
| " | N,N'-tetramethyl-ethylenediamine | methanol | 30 | 2 | 7 | 98 | 3.1 | 37.2 | " |

EXAMPLE 3

A mixture of 80 parts of styrene, 7 parts of chloromethylstyrene and 13 parts of acrylonitrile was added with 30 parts of dimethylformamide and 2 parts of benzoyl peroxide, and subjected to a copolymerization reaction at 60° C for 20 hours and further reacted for 3 hours at a constant temperature of 120° C.

After the solvent and unreacted monomer were distilled off at 150° C under a reduced pressure of 2 mmHg, the resulting copolymer was melt spun at 160° C to obtain a filament of 8 d/1 f having a viscosity $\eta_{rel}$ of 0.71. The spinning rate was 800 m/min.

The resulting filament was immersed in a bath prepared by dissolving 10 parts of ethylenediamine and 20 parts of hydroxylamine hydrochloride in 70 parts of water, in a bath ratio of 1:150, then heated from 20° C up to 70° C in 2 hours and further kept at 70° C for 3

EXAMPLE 5

Styrene was mixed with chloromethylstyrene in various molar ratios as shown in the following Table 5, and the resulting mixture was added with 2% by weight of benzoyl peroxide and subjected to a copolymerization reaction at 60° C for 40 hours. Then, the copolymer was subjected to a test tube spinning at a temperature range of 130° – 200° C to obtain an undrawn filament of 5 – 10 d/1 f. The resulting undrawn filament was immersed in a methanol solution containing 25% by weight of a cross-linking agent as shown in the following Table 5, heated from 20° C up to 60° C in 2 hours and further kept at 60° C for 10 hours to effect a cross-lonking treatment. The thus treated filament was washed with water and dried to obtain an object filament.

The obtained results are shown in Table 5.

Table 5

| | Styrene/ chloromethyl-styrene (molar ratio) | Spin-nablity | Cross-linking agent | Acetone insoluble part (Wt.%) | Yarn Property | | Heat treatment, 250° C, 2 hrs. |
|---|---|---|---|---|---|---|---|
| | | | | | Strength (g/d) | Elonga-tion (%) | |
| Control filament | 99.7/0.3 | good | hexamethylene-diamine | 42 | 2.5 | 21.0 | somewhat fusible |
| Filament of the present invention | 99/1 | " | " | 87 | 3.1 | 17.5 | infusible |
| " | 90/10 | " | " | 93 | 3.2 | 25.3 | " |
| " | 80/20 | " | ethylenediamine | 97 | 3.0 | 24.7 | " |
| " | 70/30 | " | " | 98 | 2.8 | 35.2 | " |
| " | 50/50 | " | " | 99 | 2.4 | 53.3 | " |

Table 5-continued

| | Styrene/ chloromethyl-styrene (molar ratio) | Spin-nablity | Cross-linking agent | Acetone insoluble part (Wt.%) | Yarn Property Strength (g/d) | Yarn Property Elonga-tion (%) | Heat treatment, 250° C, 2 hrs. |
|---|---|---|---|---|---|---|---|
| " | 20/80 | somewhat poor | " | 98 | 1.5 | 48.2 | " |
| Control filament | 10/90 | poor | " | 99 | 0.7 | 26.3 | " |

As seen from Table 5, when the copolymerization ratio of styrene to chloromethylstyrene is not less than 99/1 (molar ratio), infusible styrene copolymeric filaments can be obtained. While, when the copolymerization ratio of styrene to chloromethylstyrene exceeds 20/80 (molar ratio), the spinnability is poor and further the yarn property of the resulting filament is poor. Further, a preferable copolymerization ratio of styrene to chloromethylstyrene is 90/10 – 50/50 (molar ratio) in view of insoluble property, infusible property and yarn property.

That is, the copolymerization ratio of styrene to the olefinic compound having the functional group can be selected within the range of 99/1 – 20/80 (molar ratio), preferably 90/10 – 50/50 (molar ratio) in view of the spinnability, cross-linking ability, insoluble property, infusible property and yarn property.

EXAMPLE 6

A mixture of styrene and a vinyl compound having a functional group as shown in the following Table 6 in a molar ratio of 85/15 was subjected to a pearl copolymerization or an ion copolymerization. The resulting copolymer was melt spun at a spinning temperature of 150° – 170° C under a nitrogen atmosphere to obtain an undrawn filament of 5 – 15 d/1 f. The resulting filament was immersed in a cross-linking bath as shown in the following Table 6 in a bath ratio of 1:100, heated from 20° C up to 60° – 120° C in 3 hours and further kept at 60° – 120° C for 5 – 15 hours to effect a cross-linking treatment. The thus treated filament was washed with water and dried to obtain results as shown in Table 6.

Table 6

| Vinyl compound | Cross-linking bath: Cross-linking agent | Cross-linking bath: Solvent | Cross-linking bath: Concen-tration (%) | Benzene Insoluble part (Wt.%) | Yarn property: Strength (g/d) | Yarn property: Elonga-tion (%) | Heat treatment, 280° C, 3 hrs. |
|---|---|---|---|---|---|---|---|
| p-Aminomethyl styrene | ethylene dibromide | tetrahydro-furan | 10 | 93 | 1.3 | 25.1 | infusible |
| " | formaldehyde | concentrated hydrochloric acid | 15 | 94 | 1.1 | 21.2 | " |
| " | tolylene diisocyanate | tert-butanol | 5 | 89 | 0.8 | 12.9 | " |
| " | terephthalic acid dichloride | " | 10 | 91 | 1.0 | 15.4 | " |
| Methacrylic acid | ethylene glycol bisglycidyl ether | " | 15 | 89 | 1.1 | 19.5 | " |
| " | ethylene dibromide | tetrahydro-furan | 15 | 90 | 0.7 | 11.5 | " |
| " | ethylene diamine | dioxane | 90 | 85 | 0.9 | 10.4 | infusible but slight sticking between filaments |
| p-Hydroxymeth-yl-styrene | xylylene diisocyanate | tetrahydro-furan | 5 | 95 | 2.1 | 30.2 | infusible |
| " | adipic acid dichloride | tert-butanol | 8 | 91 | 1.1 | 19.2 | " |
| Allyl alcohol | diphenylmethane diisocyanate | " | 10 | 87 | 1.3 | 13.5 | " |
| Acrylic acid chloride | ethylenediamine | isopropanol | 35 | 94 | 1.7 | 21.4 | " |
| " | disodium salt of ethylene glycol | tetrahydro-furan | 10 | 88 | 1.1 | 13.4 | " |
| Methyl methacrylate | " | ethylene glycol | 40 | 91 | 1.3 | 21.4 | " |
| " | ethylenediamine | dioxane | 50 | 87 | 1.1 | 13.4 | " |
| Vinyl chloride | " | methanol | 70 | 91 | 0.7 | 12.3 | infusible but sticking between filaments |
| Vinylidene chloride | ethylene dithio glycol | water-methanol (1:1) | 30 | 87 | 0.6 | 7.2 | " |

EXAMPLE 7

50 parts of polystyrene having a molecular weight of 700,000 and 50 parts of the copolymer prepared by copolymerizing stryene with chloromethylstyrene in a molar ratio of 10/90 in Example 5 were mixed in chip forms. The resulting mixture was supplied to an extruder of 40 mmϕ, mixed, melted and formed into chips at a temperature of 230° C. The resulting chips were extruded through an extrusion spinning machine of 20 mmϕ at a spinneret temperature of 180° C at a spinning rate of 800 m/min to obtain a filament of 50 d/20 f. A circular knitted goods was prepared from the filaments.

The knitted goods was immersed in a methanol solution containing 30% of ethylenediamine, heated from 30° C up to 55° C in 2 hours and further kept at 55° C for 10 hours to effect a cross-linking treatment. The thus treated knitted goods was washed with water thoroughly and dried.

The resulting knitted goods was infusible, and was merely carbonized even when heated to redness by a burner.

What is claimed is:

1. A method for producing infusible and insoluble styrene copolymer fibers which comprises copolymerizing monomers consisting essentially of styrene and at least one ethylenically unsaturated comonomer having one of the following two formulae

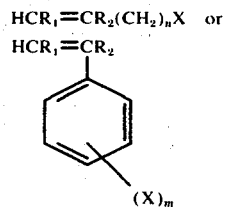

wherein $R_1$ is hydrogen, alkyl having 1 to 4 carbon atoms, halogen carboxyl or ester thereof, $R_2$ is hydrogen, alkyl having 1 to 4 carbon atoms or phenyl, X is haloalkyl, amino, carboxyl, carboxylic acid ester, carboxylic acid halide, hydroxyl, amido, nitrile or halogen, *n* is 0 or 1 and *m* is 1, 2 or 3, in a molar ratio of stryene to said comonomer of 99/1 to 20/80, to form a styrene copolymer having a molecular weight of 2,000 to 500,000, melt spinning the resulting styrene copolymer into fibers, immersing said fibers in a liquid solution of a cross-linking agent, said solution having an initial temperature of from 20° to 30° C, then raising the temperature of said solution to form 50° to 120° C. in a period of 0.5 to 10 hours and then maintaining the solution at the latter temperature for 1 to 20 hours while maintaining said fibers immersed in said solution to complete the cross linking throughout the entire cross section of the fibers whereby to obtain infusible and insoluble fibers.

2. A method as claimed in claim 1, wherein the molar ratio of styrene to comonomer is 95/5 – 40/60.

3. A method as claimed in claim 1, wherein the melt spinning is effected at a temperature of 100° to 250° C.

4. A method as claimed in claim 1, wherein the molecular weight of the styrene copolymer is 20,000 – 100,000.

5. A method as claimed in claim 1, wherein the cross-linking agent is used at a concentration of 0.5 – 60% by weight.

6. A method as claimed in claim 5, wherein said concentration is 5 – 40% by weight.

7. A method as claimed in claim 1, wherein said melt spinning is effected at a draft ratio of 500 – 1,000 m/min.

8. A method as claimed in claim 1, wherein said cross-linking agent contains 5 – 30% by weight of a ketone or an aromatic solvent as a swelling agent.

9. A method as claimed in claim 1, wherein X is haloalkyl and said cross-linking agent is selected from the group consisting of an amino compound, a diol compound, a phosphorus compound and a sulfur compound.

10. A method as claimed in claim 1, wherein X is amino and said cross-linking agent is selected from the group consisting of an aldehyde compound, a diisocyanate compound, a compound containing at least two haloalkyl groups, dicarboxylic acid compound and dicarboxylic acid dichloride compound.

11. A method as claimed in claim 1, wherein X is carboxyl and said cross-linking agent is selected from the group consisting of bisdiglycidyl ether, a compound containing at least two haloalkyl groups and amino compound.

12. A method as claimed in claim 1, wherein X is carboxylic acid halide and said cross-linking agent is selected from the group consisting of an amino compound and a diol compound.

13. A method as claimed in claim 1, wherein X is hydroxyl and said cross-linking agent is selected from the group consisting of a diisocyanate compound and a dicarbonic acid dichloride.

14. A method as claimed in claim 1, wherein X is amido and said cross-linking agent is an aldehyde compound.

15. A method as claimed in claim 1, wherein X is nitrile and said cross-linking agent is an aminoxime compound.

16. A method as claimed in claim 1, wherein X is halogen and said cross-linking agent is selected from the group consisting of an amino compound and a sulfur compound.

17. A method for producing infusible and insoluble styrene copolymer fibers which comprises blending styrene homopolymer with a styrene copolymer obtained by copolymerizing monomers consisting essentially of styrene and at least one ethylenically unsaturated comonomer having one of the following two formulae

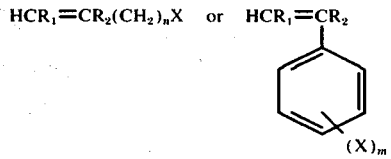

wherein $R_1$ is hydrogen, alkyl having 1 to 4 carbon atoms, halogen, carboxyl or the ester group thereof, $R_2$ is hydrogen, alkyl having 1 to 4 carbon atoms or phenyl, X is haloalkyl, amino, carboxyl, carboxylic acid ester, carboxylic acid halide, hydroxyl, amido, nitrile or halogen, *n* is 0 or 1 and *m* is 1, 2 or 3, melt spinning the resulting blend into fibers, immersing said fibers in a liquid solution of a cross-linking agent, said solution having an initial temperature of from 20° to 30° C., then raising the temperature of said solution to from 50° to 120° C. in a period of 0.5 to 10 hours and then maintaining the solution at the latter temperature for 1 to 20 hours while maintaining said fibers immersed in said solution to complete the cross linking throughout the entire cross section of the fibers whereby to obtain infusible and insoluble fibers.

* * * * *

UNITED STATES PATENT AND TRADEMARK OFFICE

CERTIFICATE OF CORRECTION

PATENT NO. : 4 007 250

DATED : February 8, 1977

INVENTOR(S) : Isao Kimura, Koichiro Ohtomo and Katsushi Shirane

It is certified that error appears in the above-identified patent and that said Letters Patent are hereby corrected as shown below:

Please change the residence of the inventor Koichiro Ohtomo from "Takatsuk" to ---Takatsuki---.

Column 15, line 30; change "halogen carboxyl" to ---halogen, carboxyl---.

Column 15, line 41; change "to form 50°" to ---to from 50°---.

Column 16, line 24; change "dicarbonic acid" to ---dicarboxylic acid---.

Signed and Sealed this

Third Day of May 1977

[SEAL]

*Attest:*

RUTH C. MASON
*Attesting Officer*

C. MARSHALL DANN
*Commissioner of Patents and Trademarks*